US007199686B1

(12) United States Patent
Tsai

(10) Patent No.: US 7,199,686 B1
(45) Date of Patent: Apr. 3, 2007

(54) OIL-IMMERSED AND HIGH-PRESSURE TRIPPING SWITCH STRUCTURE

(75) Inventor: Yu Tsai Tsai, Taoyuan Hsien (TW)

(73) Assignee: Jaker Electric Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/240,399

(22) Filed: Oct. 3, 2005

(51) Int. Cl.
*H01H 75/12* (2006.01)

(52) U.S. Cl. ..... 335/6; 335/37

(58) Field of Classification Search ..... 335/6, 335/29, 37, 164, 168; 361/37
See application file for complete search history.

(56) References Cited

U.S. PATENT DOCUMENTS 4,435,690 A * 3/1984 Link et al. ..... 335/37
4,591,816 A * 5/1986 Mikulecky et al. ..... 335/6
4,611,189 A * 9/1986 Mikulecky ..... 335/37
4,617,545 A * 10/1986 Link ..... 337/74
6,331,685 B1 * 12/2001 Maldonado-Cortes ..... 200/17 R

* cited by examiner

*Primary Examiner*—Ramon M. Barrera
(74) *Attorney, Agent, or Firm*—Troxell Law Office, PLLC

(57) ABSTRACT

An oil-immersed and high-pressure tripping switch structure comprises an operational apparatus, an arc-extinguishing cylinder, and an oil-shortage automatic tripping safety device wherein a sensory device detecting a fault current will trip open to displace a spring rebound pivoting-point, permitting a main spring to simultaneously actuate the release of contact points and the rotation of an operational handle therewith so that the operational handle is rotated to recover its primary angle so as to indicate the tripped/off status of the switch, facilitating the judgment and operation of workers. In addition, via a buoyant tube combined with an oil-retaining tank, the buoyant tube in case of oil-shortage can generate a sufficient downward pressure to activate the release of a tripping device so as to ensure the safety of the present invention in operation. Furthermore, a complex arc-interruption mechanism is applied so that the arc-extinguishing cylinder can efficiently break higher fault current thereby.

2 Claims, 20 Drawing Sheets

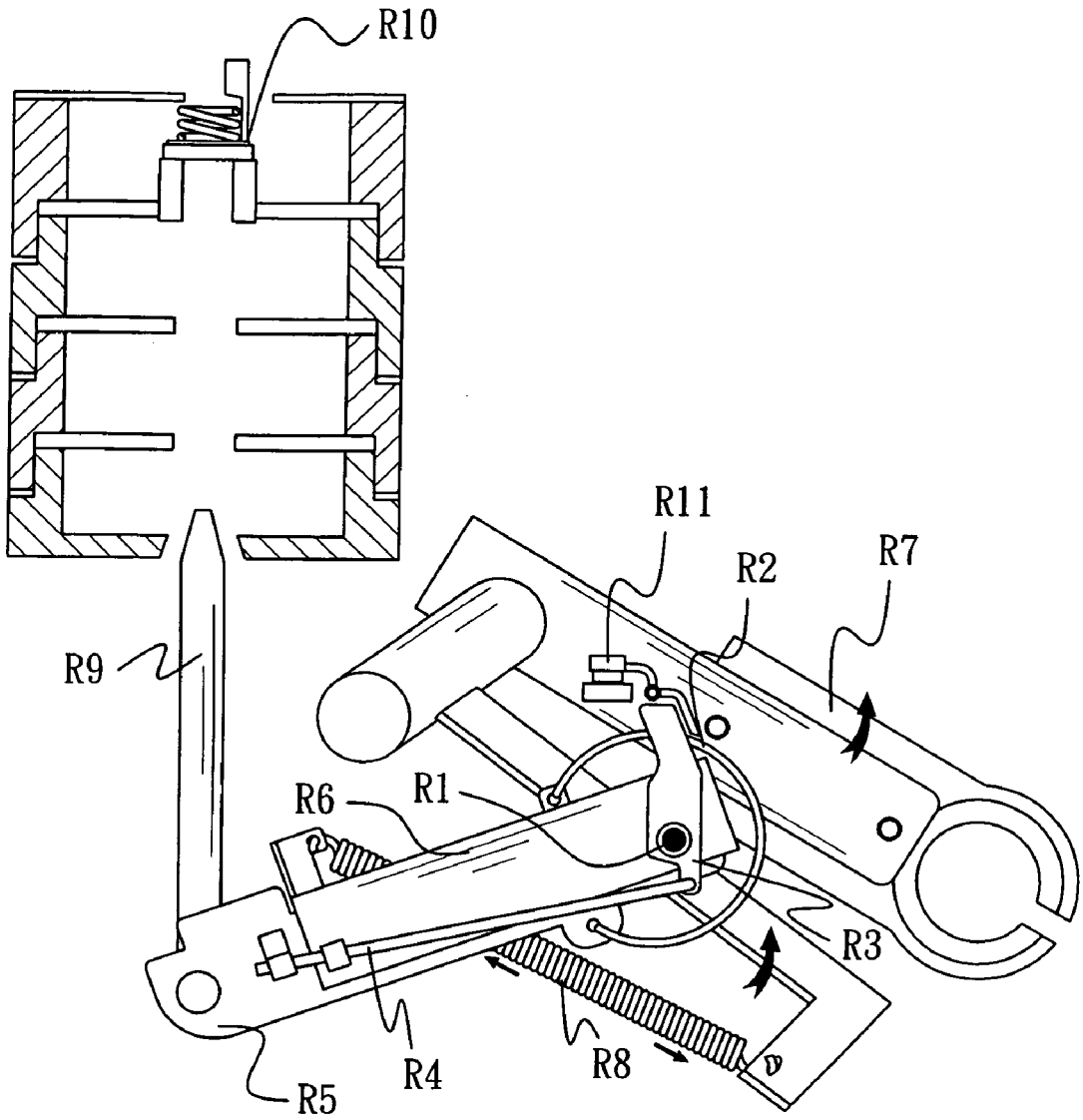
FIG.1-A
PRIOR ART

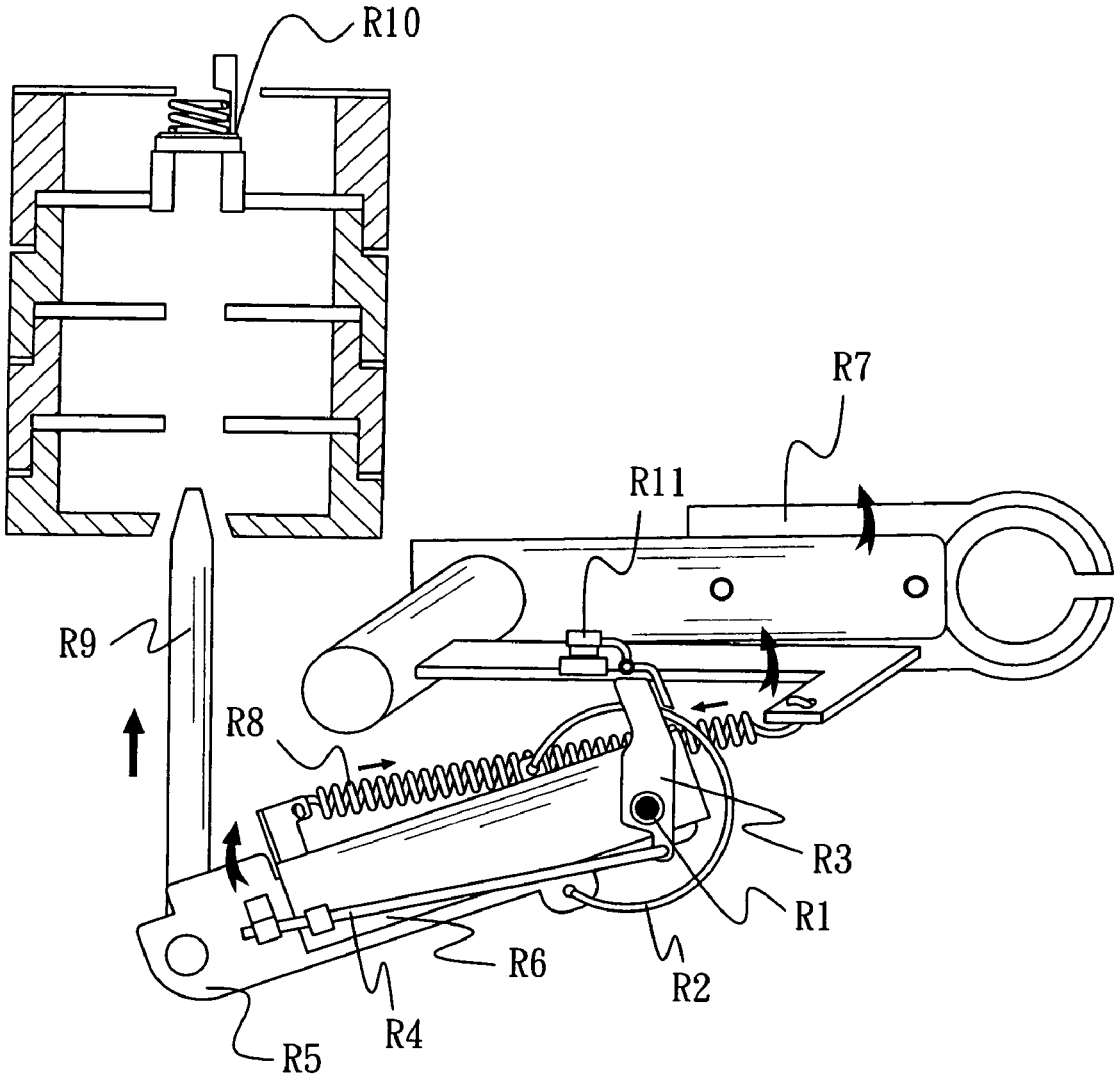
FIG.1-B
PRIOR ART

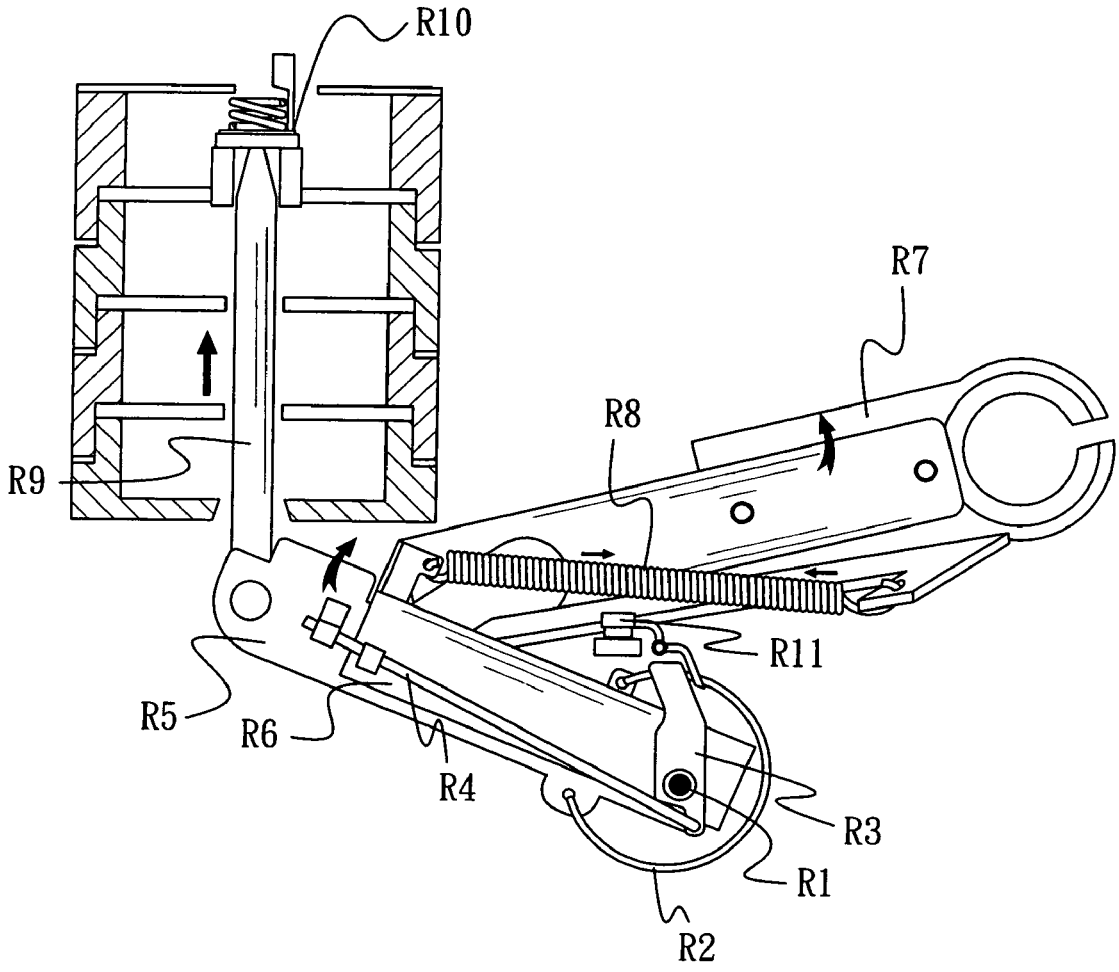
FIG.1-C
PRIOR ART

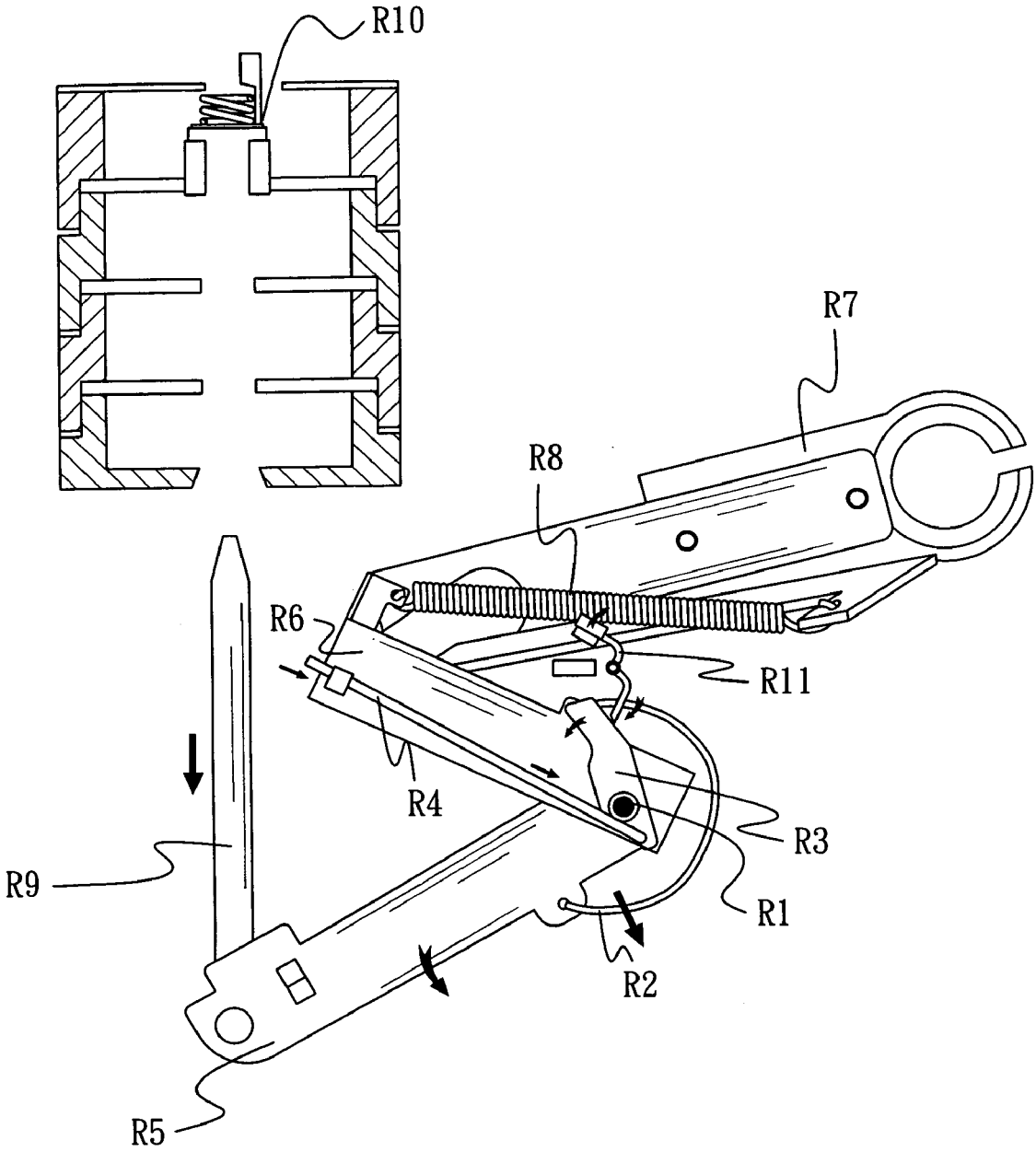
FIG. 1-D
PRIOR ART

OIL-IMMERSED AND HIGH-PRESSURE TRIPPING SWITCH STRUCTURE

BACKGROUND OF THE INVENTION

The present invention is related to an oil-immersed and high-pressure tripping switch structure, comprising an operational apparatus, an arc-extinguishing cylinder, and an oil-shortage automatic tripping safety device wherein a sensory device detecting a fault current will trip open to displace a spring rebound pivoting-point, permitting a main spring to simultaneously actuate the release of contact points and the rotation of an operational handle therewith so that the operational handle is rotated to recover its primary angle so as to indicate the tripped/off status of the switch, facilitating the judgment and operation of workers. In addition, via a buoyant tube combined with an oil-retaining tank, the buoyant tube in case of oil-shortage can generate sufficient downward-pressure to activate the release of a tripping device so as to ensure the safety of the present invention in operation. Furthermore, a complex arc-quenching mechanism is applied so that the arc-extinguishing cylinder can efficiently break higher fault current thereby.

Please refer to FIGS. 1-A, 1-B, 1-C, and 1-D. For decades, oil-immersed and high-pressure tripping switches have been applied to transformers to prevent the over-current condition thereof. A conventional oil-immersed and high-pressure tripping switch usually found on the market utilizes a fixed spring rebound pivoting-point R1, and a tripping mechanism having a ring-shaped trip spring R5 applied thereto. To set the switch in operation, an actuating linkage rod R4 of a tripper R3 is first connected to a contact point crank R5 and a main spring rotating crank R6. Meanwhile, the ring-shaped trip spring R2 is built up in strength as shown in FIG. 1-A. An operational handle R7 is rotated to activate the stretching movement of a main spring R8. When the main spring R8 is rotated to exceed the rebound pivoting-point R1, the main spring R8 will contract in opposite directions as shown in FIG. 1-B, speedily actuating the movement of the main spring rotating crank R6 and the contact point crank R5 therewith so as to allow a movable contact point R9 of the switch thereof to close onto a fixed contact point RIO as shown in FIG. 1-C. And a switch current sensory device R11 detecting a fault current will activate the tripper R3 and the actuating linkage rod R4 therewith, releasing the contact point crank R5 to detach from the main spring rotating crank R6. Meanwhile, the ring-shaped trip spring R2 will undergo an expansion movement to actuate the contact point crank R5 rotating downwards and making the movable contact point R9 to detach from the fixed contact point R10 thereof. Due to the main spring R8 still remained in the first adjusted status, the operational handle R7 will stay in the former switched-on position as shown in FIG. 1-D. Therefore, a worker can't judge from the external look of the switch if it has been shutdown in a tripped status, which can not only increase the chance of accident, but may easily cause mistakes in operation thereof.

In case of a leakage of the insulating oil due to the corrosion or breaking of the case of the transformer, the continuity in the supply of electricity will result in the insufficient insulation distance and cause the accident of electrical-arc blast. At present, the high-pressure tripping switch on the market cannot detect the shortage of oil and automatically trip off in case of the oil-shortage. Thus, in addition to the failure to insulate the transformer in advance before it works under the condition of insufficient oil, the conventional high-pressure tripping switch under the shortage of insulating oil may fail to successfully cut off the supply of electricity and break the circuit thereof, which can lead to the disaster of electrical-arc blast and endanger the lives of workers.

Moreover, the arc-extinguishing cylinder of the conventional high-pressure tripping switch is designed in a half-enclosed form so as to reduce the pressure of the vaporized oil generated in the process of arc-interruption, which makes it to trip at rather small fault current. As a result, series of low-current and backup fuses must be strung to match with the conventional high-pressure tripping switch. Thus, the conventional high-pressure stripping switch is uneconomically limited in the range of protection thereof.

SUMMARY OF THE PRESENT INVENTION

It is, therefore, the primary purpose of the present invention to provide an oil-immersed and high-pressure tripping switch structure wherein a single main spring is applied and, via the displacement of a spring rebound pivoting-point, the main spring is changed in the direction of motion so as to easily achieve various mechanisms such as the switch-on, the automatic trip-off, and the indication of movement thereof. Besides, the linkage rotating rod of an operational handle and a rotary arm actuating the main spring thereof are not connected in a concentric arrangement so as to increase the swinging range thereof in operation. In addition to saving a lot of efforts in operation, the operational handle when tripped will swing in a larger range to obviously indicate the tripped/off status thereby.

It is, therefore, the second purpose of the present invention to provide an oil-immersed and high-pressure tripping switch structure wherein an automatic tripping safety device is provided to trip/off the switch in case of an oil-shortage. Besides, the tripping safety device is equipped with an anti-shock property to prevent any mistakes in operation caused by vibrations or earthquakes. The shock-resistant and oil-shortage automatic tripping safety device includes an oil-retaining tank with an upper opening, a buoyant tube coupled with the oil-retaining tank disposed on top thereof before put into a damping oil cup disposed at the bottom thereof, and a linkage rod extending from the bottom of the buoyant tube and right through the damping oil tank thereof to connect with one end of an oil-shortage tripping device thereby. The buoyant tube and the oil-retaining tank are immersed in the insulating oil without the buoyant tube floating on the oil surface. With the effect of the damping oil cup, the tripping device will almost not be shaken along in case any vibrations occur. Thus, the switch will not be mistakenly operated due to the vibrations thereof. When an oil-shortage causes the oil surface to lower down, the oil-retaining tank filled with the insulating oil will gradually emerge to the oil surface till the weight of the insulating oil stored inside the oil-retaining tank will directly activate the tripping device of the switch thereof so as to achieve an automatic tripping mechanism in case of oil-shortage thereof.

It is, therefore, the third purpose of the present invention to provide an oil-immersed and high pressure tripping switch structure wherein an arc-extinguishing cylinder is provided, utilizing a complex arc-quenching mechanism in which a spray-type arc-interrupting chamber is applied to expel vaporized-oil upwards and a side-blowing arc-interrupting chamber is set to cut the electrical arc sideways into pieces and have the vaporized-oil discharged outwards there-from. When a movable contact point is detached from a fixed contact point of the switch thereof to generate an electrical arc thereby, the insulating oil will immediately fill up the space opened there-between to cool down the high temperature electrical arc with a large amount of vaporized-oil produced in the process to be emitted via the spray-type arc-interrupting chamber disposed at the upper section thereof so as to break the continuation of the electrical arc thereby. When the movable contact point moves through the side-blowing arc-interrupting chamber, if the electrical arc is still unquenched, the single gas-emitting channel of the side-blowing arc-interrupting chamber and the expanded vaporized-oil will generate a side-blowing pressure to break the electrical arc in a transverse direction. Furthermore, the arc-extinguishing cylinder is integrally molded and built up in strength to resist any deformation in operation thereof. Therefore, the present invention can safely and reliably break higher fault current than the above-mentioned prior art thereof.

BRIEF DESCRIPTION OF THE DRAWINGS

FIG. 1-A is a diagram showing the structure and mechanism of a conventional high-pressure tripping switch structure.

FIG. 1-B is another diagram showing the structure and mechanism of the conventional high-pressure tripping switch of FIG. 1-A.

FIG. 1-C is a third diagram showing the structure and mechanism of the conventional high-pressure tripping switch of FIG. 1-A.

FIG. 1-D is a fourth diagram showing the structure and mechanism of the conventional high-pressure tripping switch of FIG. 1-A.

DETAILED DESCRIPTION OF THE PREFERRED EMBODIMENTS

Figure 2:
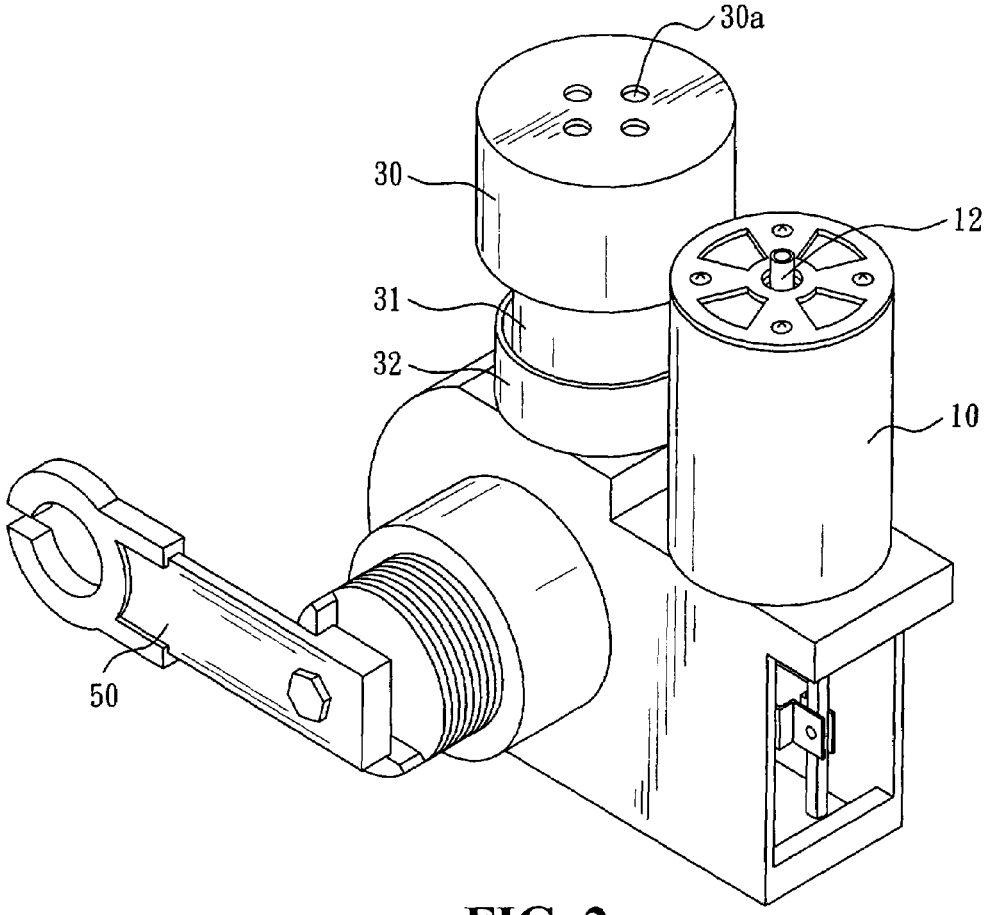
FIG. 2 is a perspective view of the present invention looked from outside.
Figure 3:
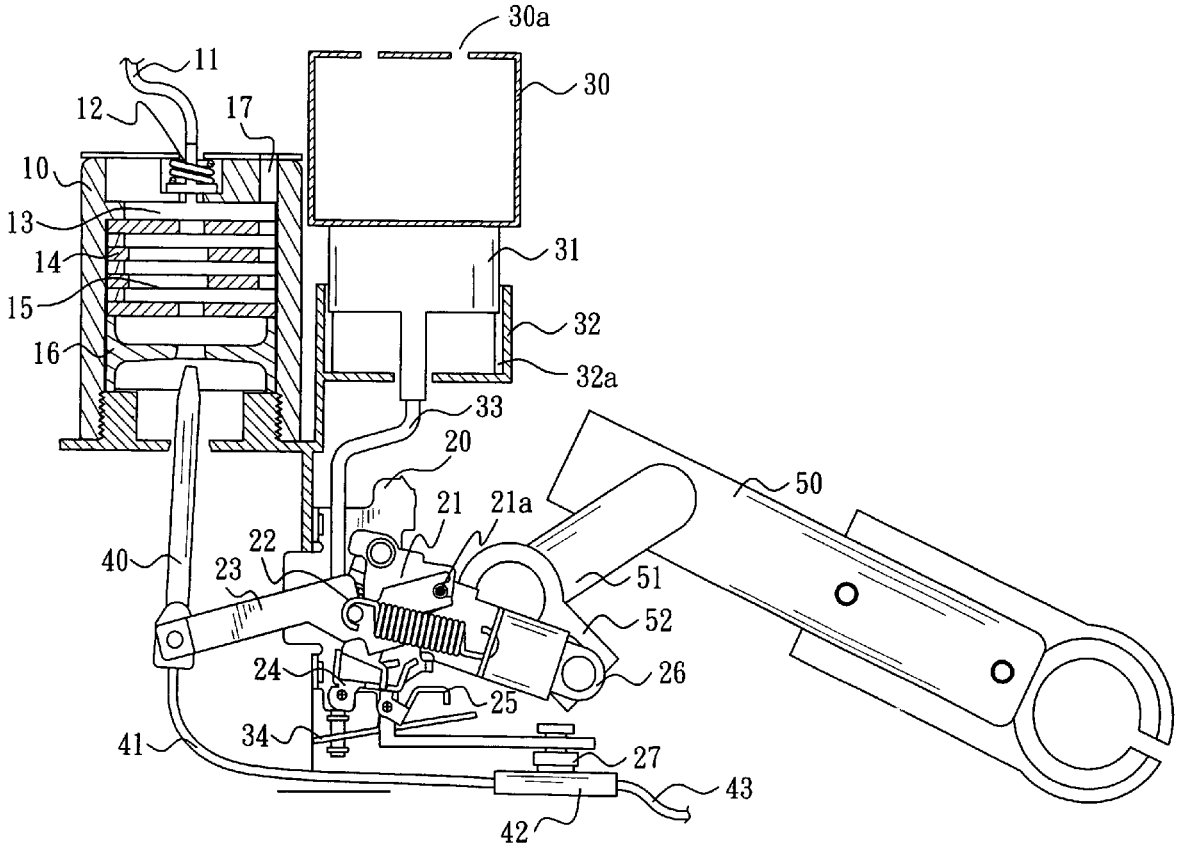
FIG. 3 is a cross sectional and detailed view of the present invention.

Please refer to FIG. 2 showing a perspective view of the present invention (accompanied by FIG. 3 showing a detailed illustration of the mechanism of the present invention). The present invention is related to an oil-immersed and high-pressure tripping switch structure, comprising an operational apparatus, an arc-extinguishing cylinder, and an oil-shortage automatic tripping safety device. The arc-extinguishing cylinder 10 includes an electrical side connecting wire 11, a fixed contact point 12, a spray-type arc-interrupting chamber 13, a side-blowing arc-quenching mechanism 14, a side-blowing arc-interrupting chamber 15, an aligning slide ring 16, and a sideway gas-ventilating channel 17. The operational apparatus is made up of a main support bracket 20, a rebound pivoting-point support 21, a spring rebound pivoting-point 21*a*, a main spring 22, a movable contact point crank 23, a tripper bracket 24, a trip trigger 25, a spring rotary arm 26, and an over-current magnetic tripping device 27. The oil-shortage automatic tripping safety device is composed of an oil-retaining tank 30, a buoyant tube 31, a damping oil cup 32, a linkage rod 33, and an oil-shortage tripping device 34. The present invention is also equipped with a movable contact point 40, a movable contact point connecting wire 41, an over-current sensory device 42, an overload side connecting wire 43, an operational handle 50, a linkage rotating rod 51, and a rotary shaft 52.

The rear section of the operation handle 50 thereof is coupled to one end of the linkage rotating rod 51 having the other end connected to the rotary shaft 52 thereof. The rotary shaft 52 has an indented groove disposed thereon to be engaged with one end of the spring rotary arm 26 having one end of the main spring 22 hooked to the middle section thereon. The other end of the spring rotary arm 26 is movably fitted to the main support bracket 20 of the operational apparatus thereof, and the rebound pivoting-point support 21 is rotatably mounted to the main support bracket 20 thereof. The rebound pivoting-point support 21 has the spring rebound pivoting-point 21*a* disposed at one lateral edge thereon to which the movable contact point crank 23 is secured. The trip trigger 25 is connected to one side of the rebound pivoting-point support 21 in a linkage mechanism therewith. The other end of the main spring 22 is attached to the middle section of the movable contact point crank 23. And the movable contact point 40 is fixed to the other end of the movable contact point crank 23 and cooperatively operates with the arc-extinguishing cylinder 10 thereby.

The mechanism of the present invention is respectively presented in details as follows:

A. The operational apparatus: Please refer to FIGS. 4 through 7 inclusive showing cross sectional views of the mechanism of the operational apparatus thereof.

Figure 4:
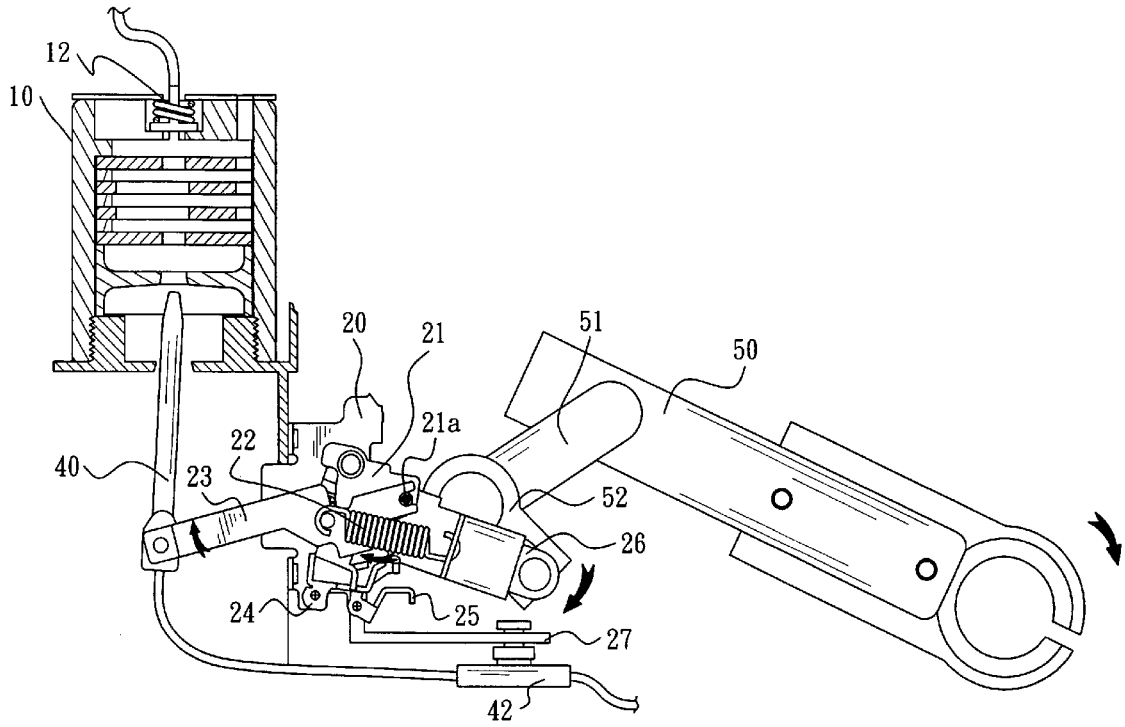
FIG. 4 is a cross sectional view of an operational apparatus with a movable contact point of the present invention in operation.

1. The operational handle 50 is rotated clockwise to actuate the movement of the linkage rotating rod 51, the rotary shaft 52, the spring rotary arm 26, and the rebound pivoting-point support 21 therewith, permitting the bottom edge of the rebound pivoting-point support 21 to fit onto the trip trigger 25 of the trip trigger bracket 24, and the over-current magnetic tripping device 27 to attach onto the over-current sensory device 42 so as to finish the first preparation before the switch is set up in operation as shown in FIG. 4.

Figure 5:
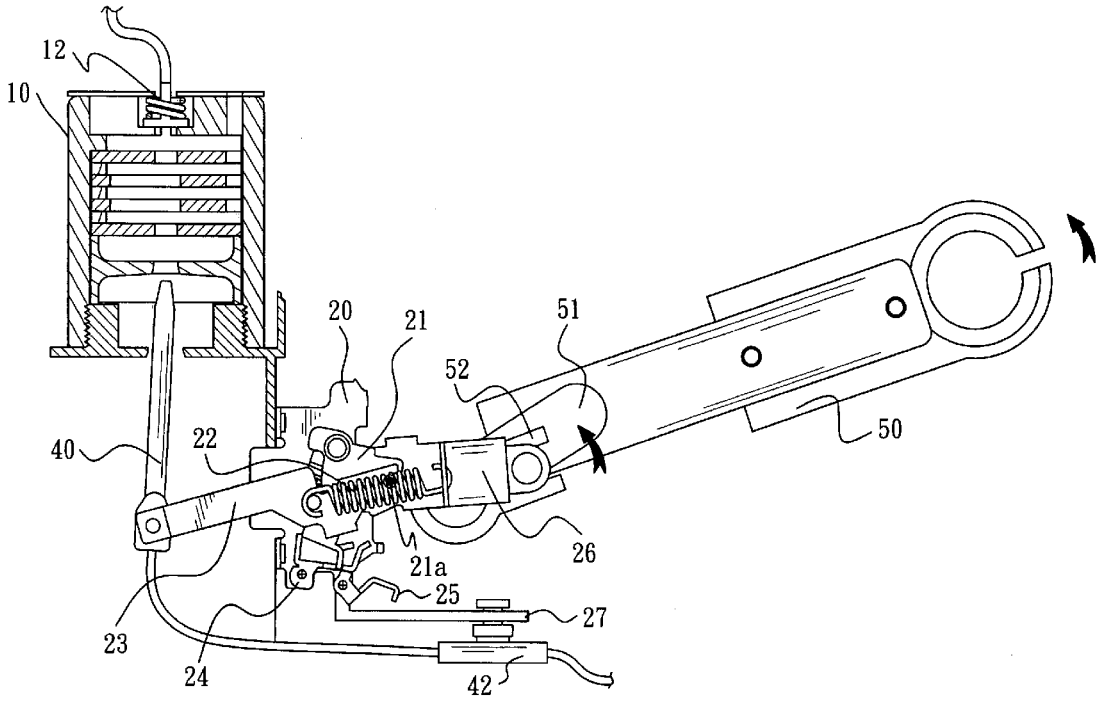
FIG. 5 is a cross sectional view of the operational apparatus of the present invention in a switched-on operation.
Figure 6:
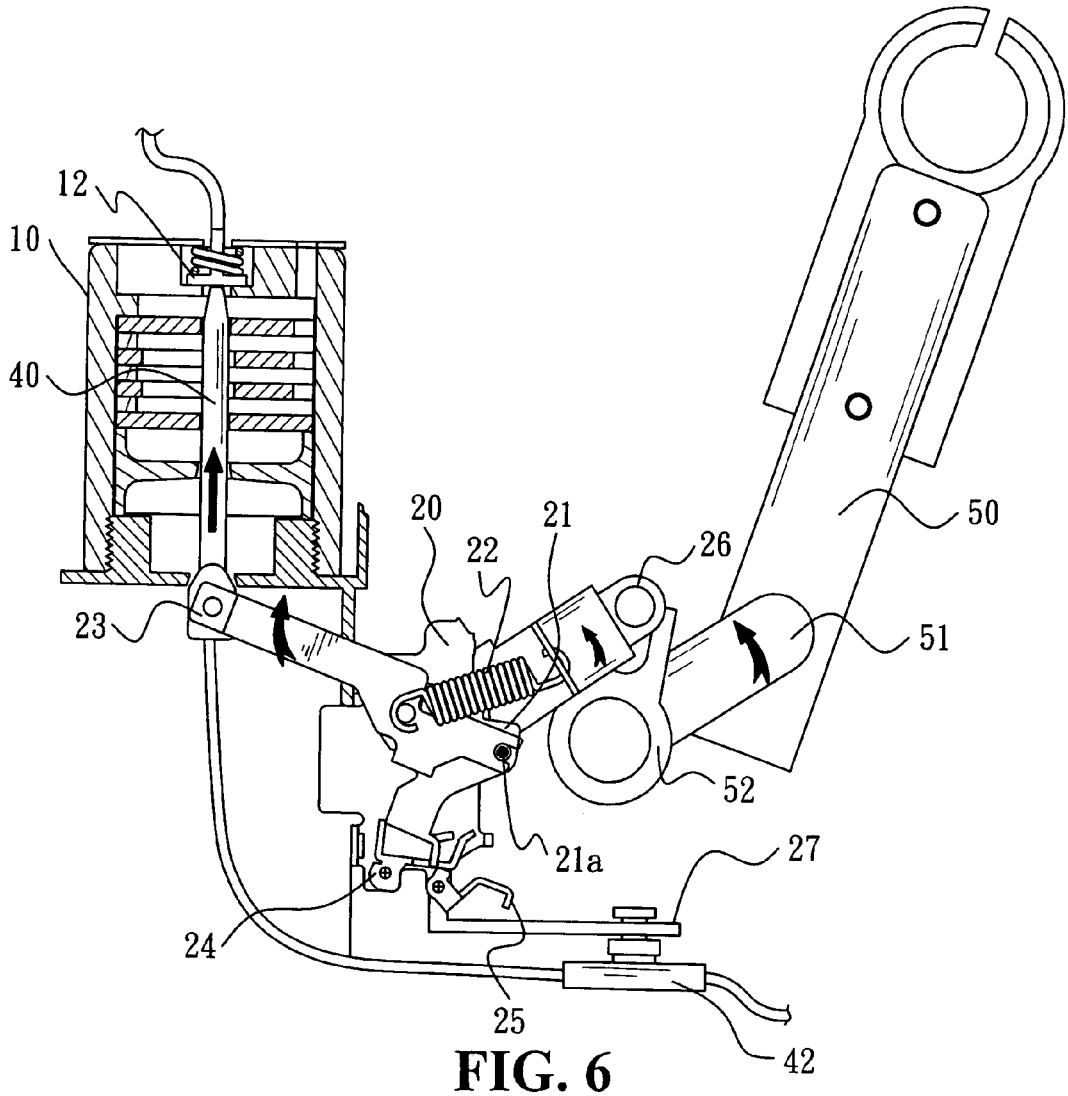
FIG. 6 is another cross sectional view of the operational apparatus of the present invention in the switched-on operation thereof.

2. The operational handle 50 is then rotated counterclockwise to activate the linkage rotating rod 51 and extend the spring rotary arm 26 so as to move the main spring 22 thereby as shown in FIG. 5. When the main spring 22 is guided to exceed the spring rebound pivoting point 21*a*, the main spring 22 will contract in opposite directions and speedily actuate the movable contact point crank 23 therewith, permitting the movable contact point 40 to move upwards till touching the fixed contact point 12 thereof. Meanwhile, the main spring 22 is kept in a half-extended status, permitting the movable contact point 40 to tightly close onto the fixed contact point 12 and complete the switch-on operation thereof as shown in FIG. 6.

Figure 7:
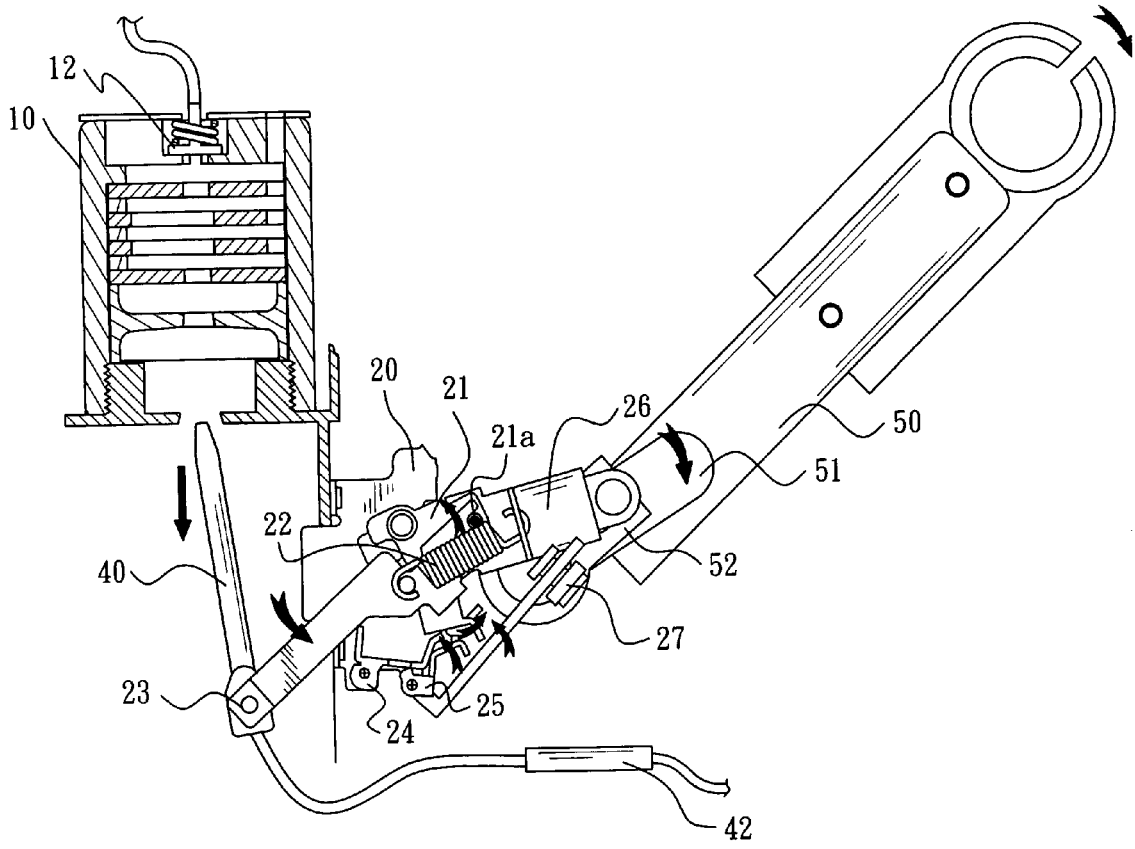
FIG. 7 is a cross sectional view of the operational apparatus of the present invention in an automatic tripping operation.
Figure 8:
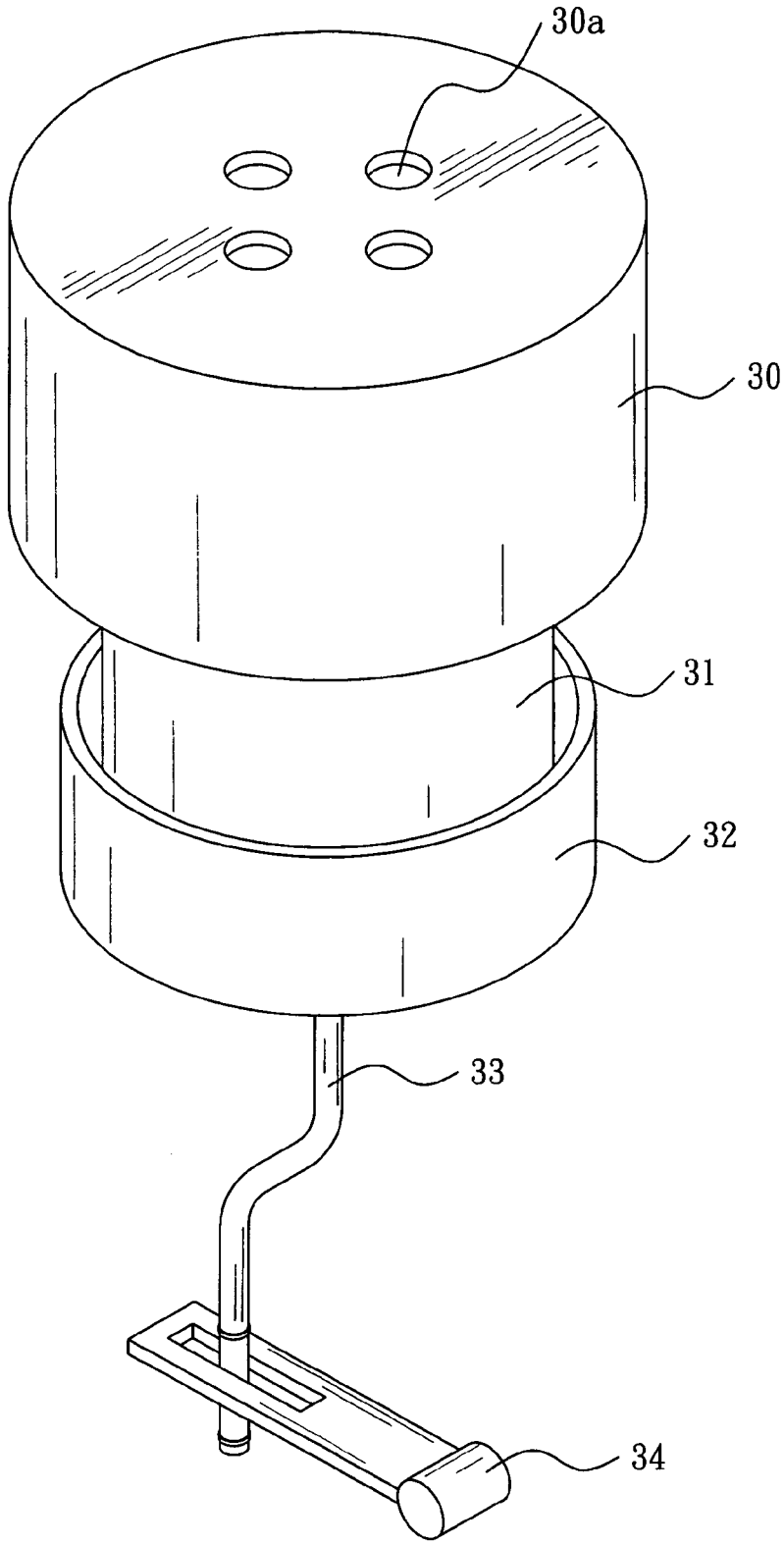
FIG. 8 is a perspective view of an automatic tripping safety device of the present invention.
Figure 9:
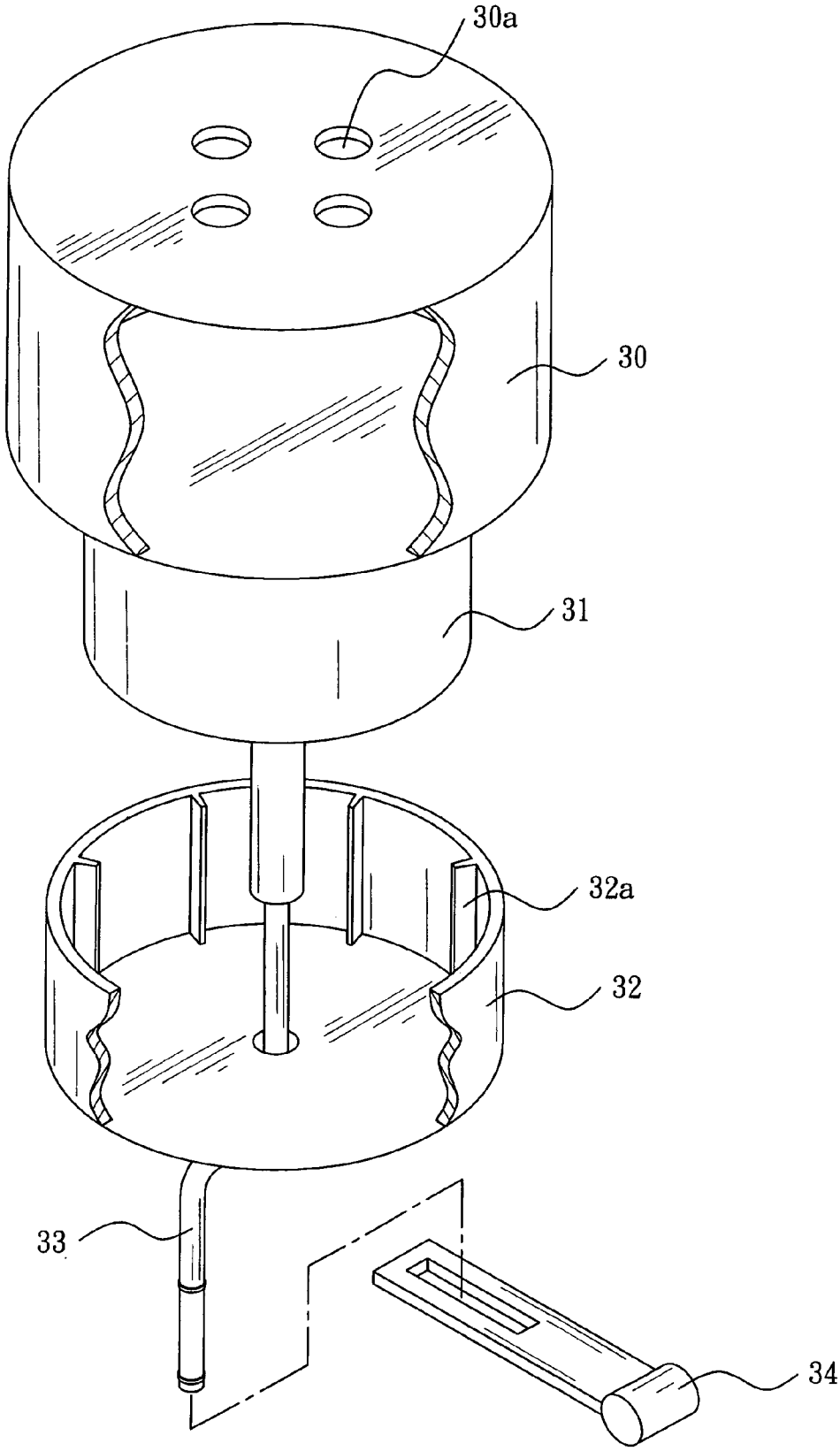
FIG. 9 is a cross sectional view of the automatic tripping safety device of the present invention.

3. When the over-current sensory device 42 detects high current passing there-through to increase temperature and reduce the magnetic conduction capability thereof, the over-current magnetic trip device 27 losing its magnetic force will detach from the over-current sensory device 42 and move in a counterclockwise direction, which in turn will activate the trip trigger 25 and force the rebound pivoting-point support 21 to move counterclockwise as well. When the spring rebound pivoting-point 21*a* is moved to exceed the main spring 22, the half-extended main spring 22 will contract in the opposite direction, speedily actuating the movable contact point crank 23 to move counterclockwise therewith and forcing the movable contact point 40 to detach from the fixed contact point 12 thereby. Meanwhile, the spring rotary arm 26, the linkage rotating rod 51, and the operational handle 50 are actuated to move in a clockwise motion therewith so that the operational handle 50 can provide an obvious signal to indicate the tripped/off status of the switch thereof as shown in FIG. 7.

B. The oil-shortage automatic tripping safety device: Please refer to FIGS. 8 through 12 inclusive. The oil-shortage automatic tripping safety device includes the oil-retaining tank 30 disposed on top of the buoyant tube 31, and the damping oil cup 21 disposed at the bottom of the buoyant tube 31 wherein the oil-retaining tank 30 has oil inlets 30*a* disposed at the top surface thereon, and the damping oil cup 32 is equipped with separation brackets 32*a* extending thereon. And the linkage rod 33 is provided extending from the bottom of the buoyant tube 31 and right through the damping oil cup 32 thereof to connect with one end of the oil-shortage tripping device 34 thereby.

Figure 10:
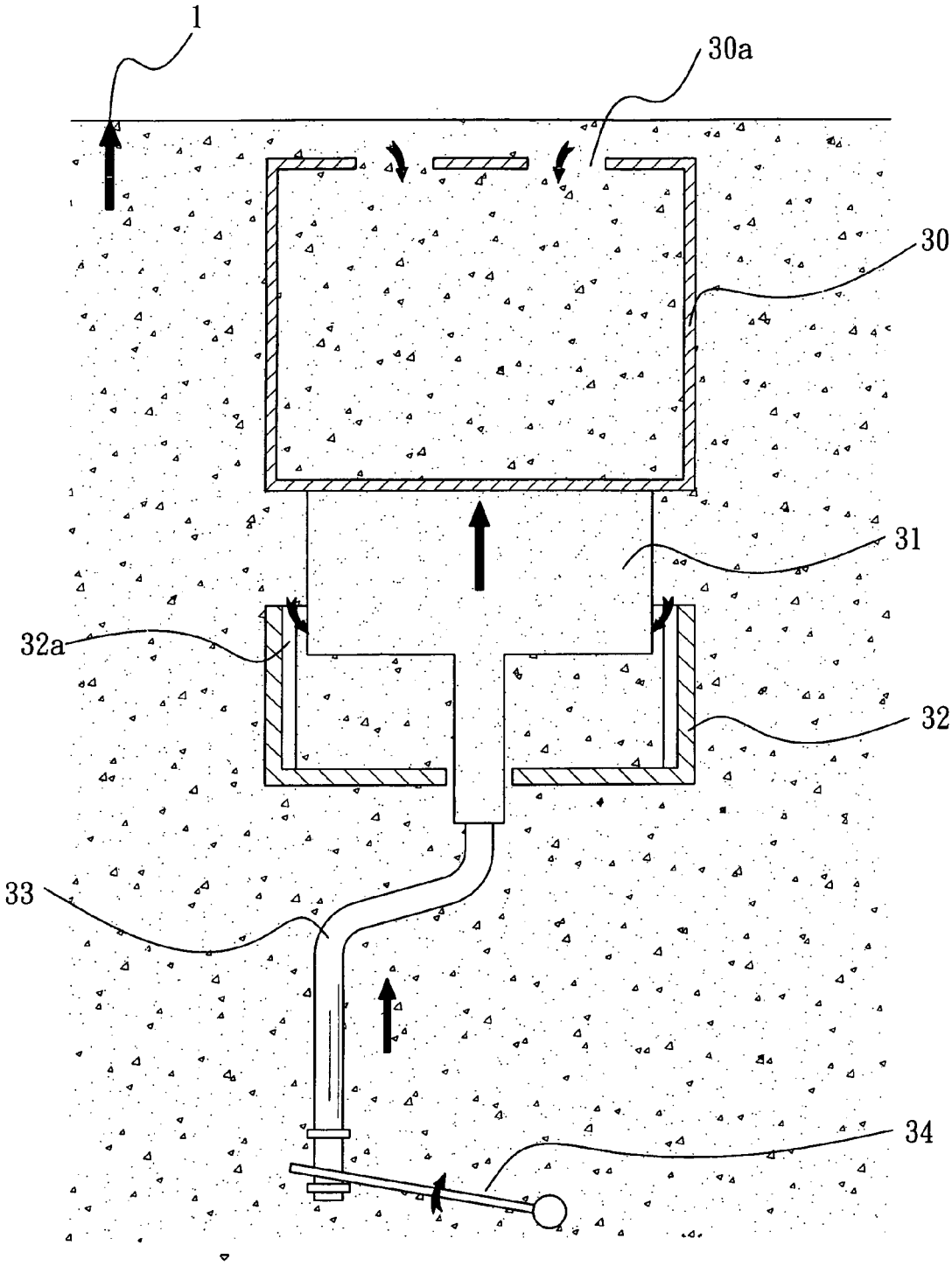
FIG. 10 is a cross sectional view of the automatic tripping safety device of the present invention immersed in insulating oil.

1. The present invention thereof is immersed in oil. When the oil stored in the case of a transformer remains on a normal level, the insulating oil will flow in through the oil inlets 30*a* disposed on the top surface of the oil-retaining tank 30 and the separation brackets 32*a* disposed between the damping oil cup 32 and the buoyant tube 31 thereof so as to fill the interior of both oil-retaining tank 30 and the damping oil cup 32 with the insulating oil thereby. The buoyant tube 31 is designed with a buoyant force slighter larger than the weight of the oil-retaining tank 30 and the linkage rod 33 immersed in the oil. Therefore, the present invention thereof will be buoyed upwards and actuate the oil-shortage tripping device 34 in a clockwise rotation as shown in FIG. 10.

Figure 11:
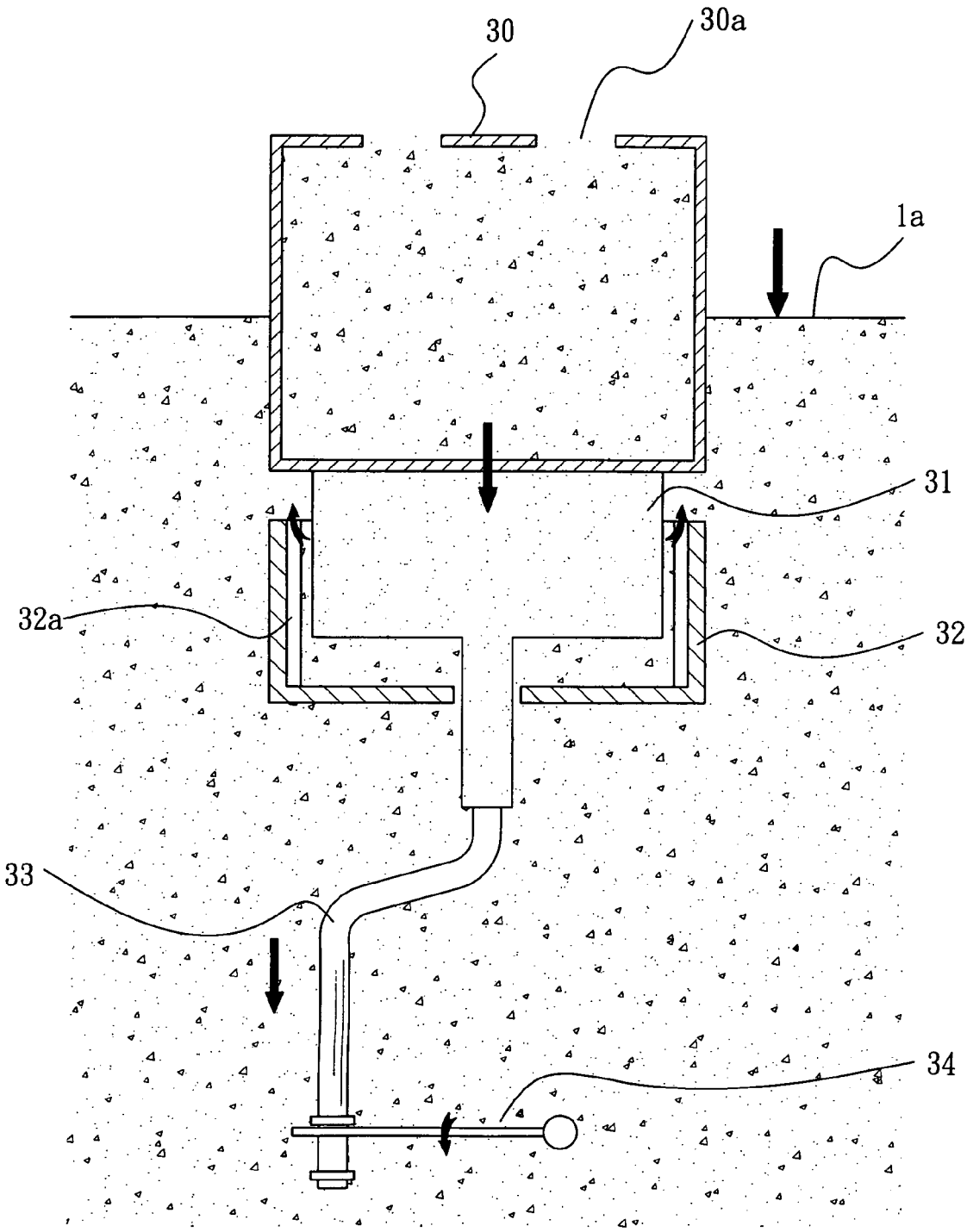
FIG. 11 is a diagram showing the mechanism of the automatic tripping safety device of the present invention in condition of an oil-shortage.

2. In case of oil leakage caused by the corrosion of the case of the transformer or impact from external articles, the oil surface 1*a* of the insulating oil stored inside the case will lower down along with the oil leakage thereof. However, the oil-retaining tank 30 thereof is still filled with the insulating oil whose weight will generate a downward pressure and build up in strength if the oil surface 1*a* keeps descending downwards. When the downward pressure becomes larger than the buoyant tube 31 and the force required to activate the oil-shortage tripping device 34 thereof, the switch will be actuated and tripped/off as shown in FIG. 11.

Figure 12:
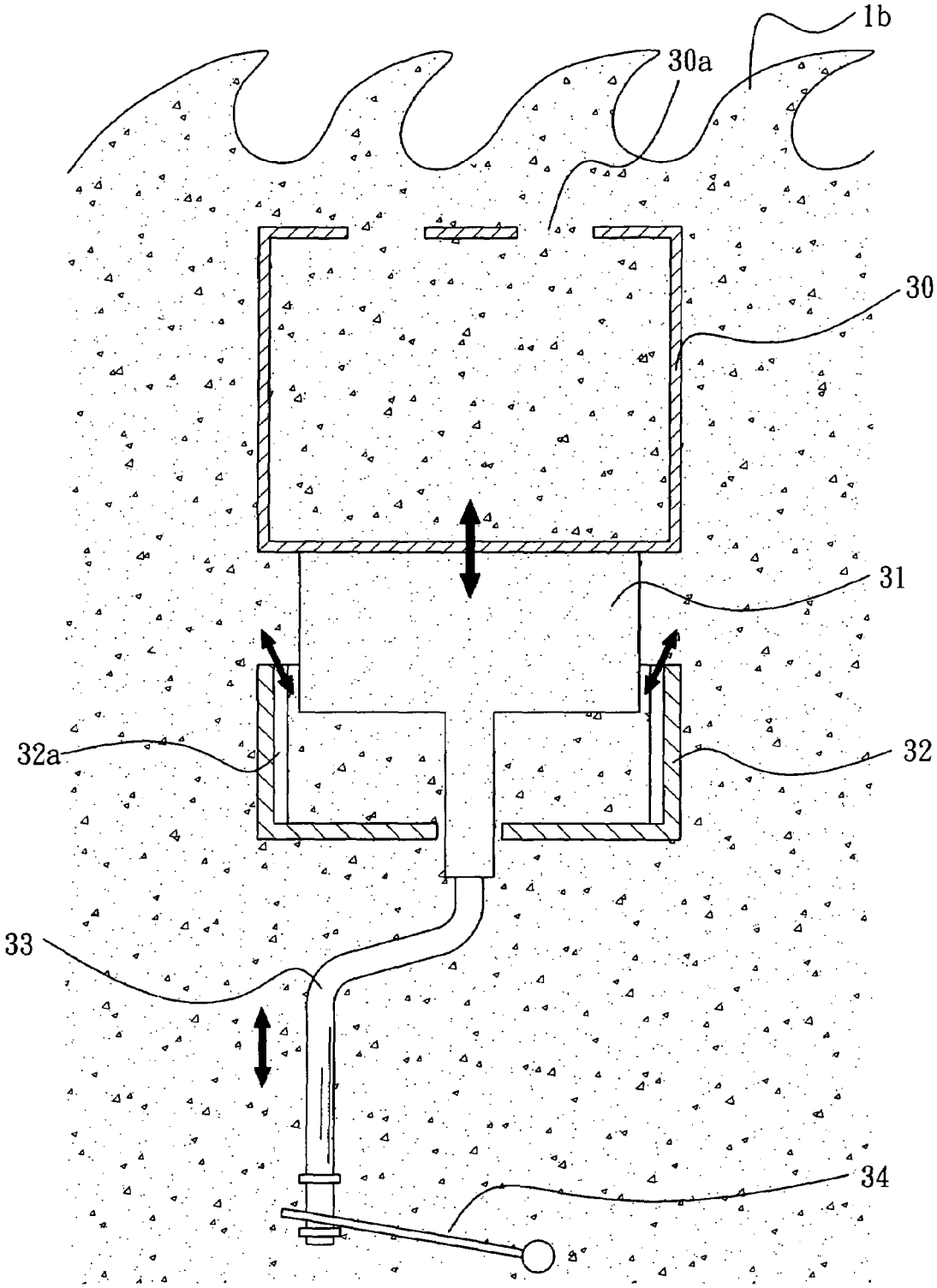
FIG. 12 is a diagram showing the mechanism of the automatic trip-off safety device of the present invention buffering the shock caused by vibrations.
Figure 13:
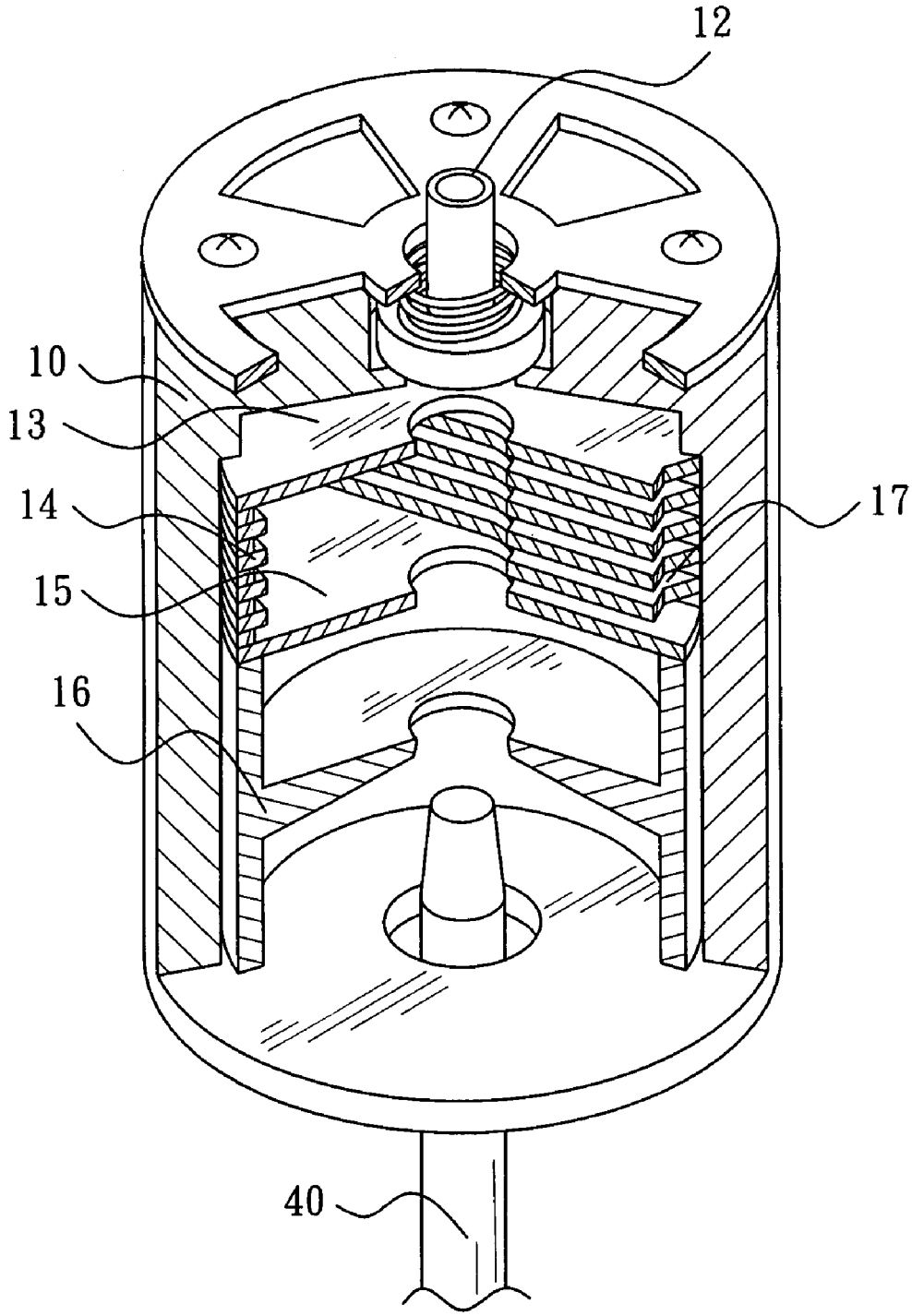
FIG. 13 is a partially perspective view of an arc-extinguishing cylinder of the present invention.

3. To protect the oil-shortage automatic tripping device from the vibration influence of earthquakes, vehicles-passages, or wind-pressure, the damping oil cup 32 is mounted at the bottom of the buoyant tube 31. The damping oil cup 32 features a plurality of the separation brackets 32*a* disposed at the inner surface thereon, permitting a certain distance apart between the buoyant tube 31 and the damping oil cup 32. When a vibration causes the oil surface 1*b* to wave up and down and makes the buoyant tube 31 shaking up and down therewith, the swinging buoyant tube 31 will squeeze out or suck in the insulating oil stored inside the damping oil cup 32 via the separation brackets 32*a* thereof so as to form a resistance to buffer partially the force generated by the vibration and, thus, reduce the vibration range of the buoyant tube 31, efficiently avoiding the mistake of accidentally tripping the switch due to the vibration thereof as shown in FIG. 12.

C. The arc-extinguishing cylinder: Please refer to FIGS. 13 through 17 inclusive. The arc-extinguishing cylinder 10 has vaporized-oil discharging orifices distributed at the upper surface thereon, and the fixed contact point 12 is fitted at the center of the top thereon. Inside the arc-extinguishing cylinder 10 is sequentially arranged from top to bottom the spray-type arc-interrupting chamber 13, and the side-blowing arc-quenching mechanism 14 equipped with the gas-emitting channel 17 and the side-blowing arc-interrupting chamber 15 thereof. And the movable contact point 40 attached at one end of the movable contact point crank 23 of the operational apparatus as shown in FIG. 3 is guided to extend through the center of the arc-extinguishing cylinder 10 and reciprocally operated with the fixed contact point 12 disposed at the top thereof.

Figure 14:
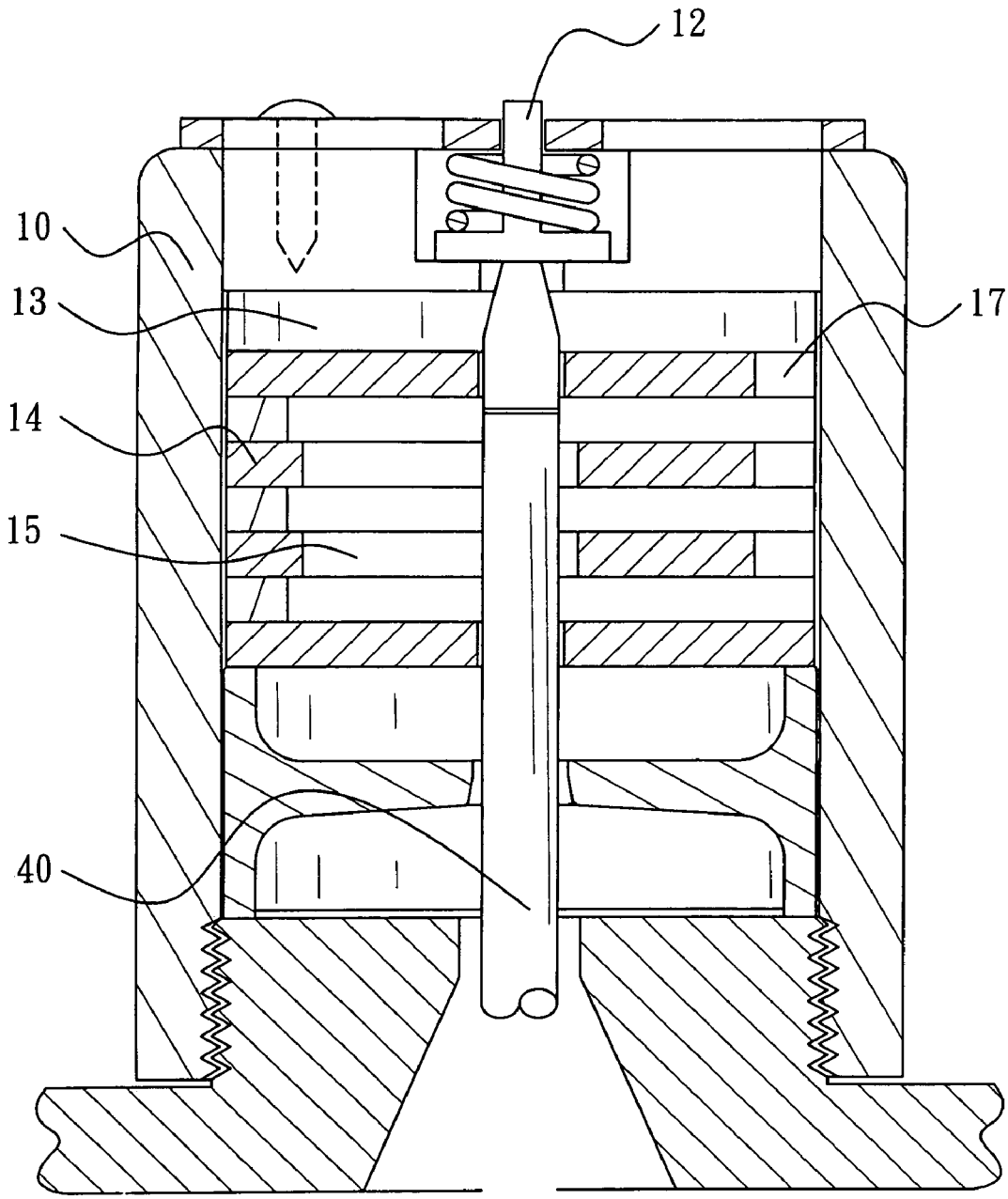
FIG. 14 is a cross sectional view of the arc-extinguishing cylinder of the present invention immersed in oil and set in a switched-on status.

1. When the switch is in a switched-on position, the movable contact point 40 is closed onto the fixed contact point 12 inside the arc-extinguishing cylinder 10 as shown in FIG. 14 wherein the arc-extinguishing cylinder 10 is completely immersed in insulating oil thereof.

Figure 15:
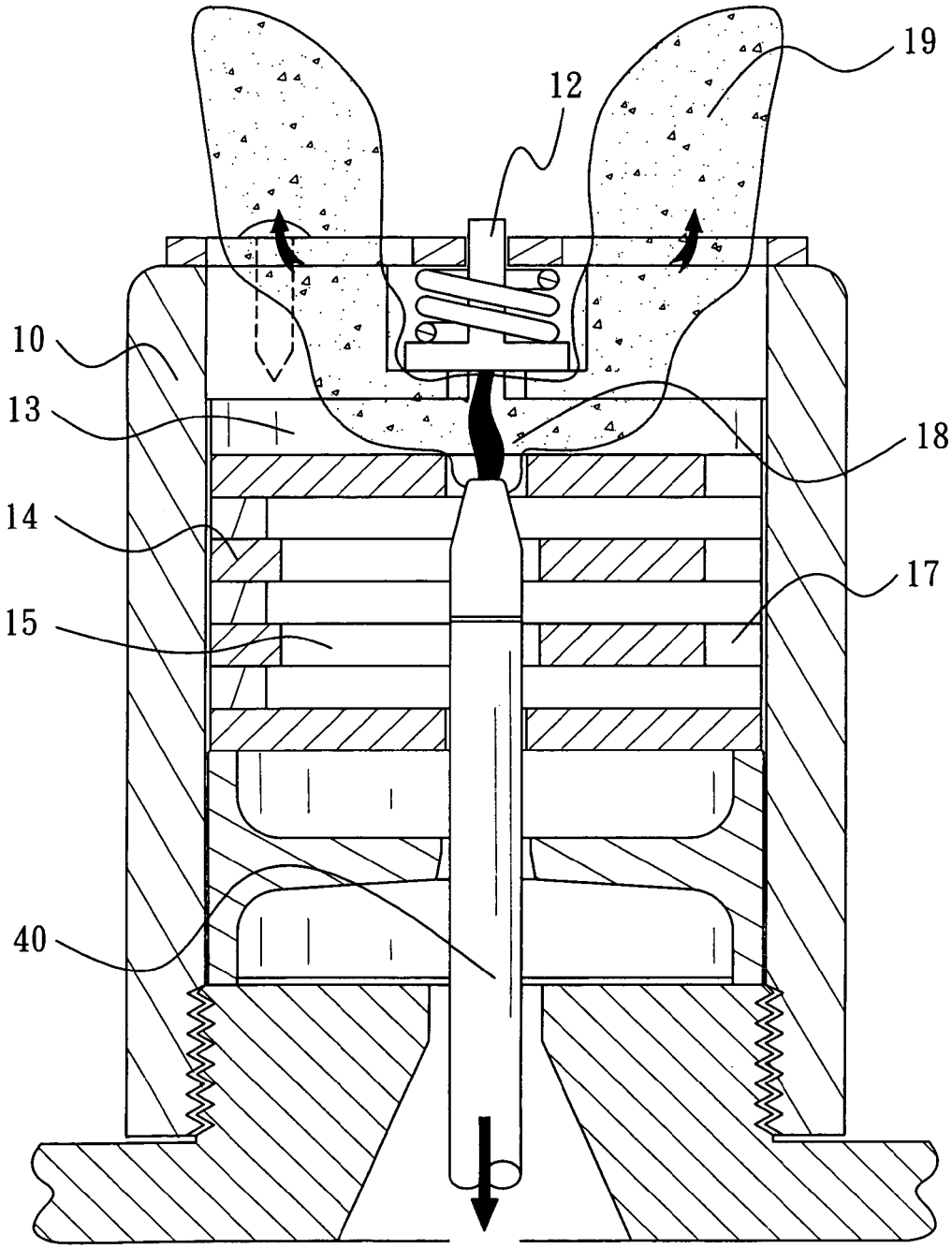
FIG. 15 is a cross sectional view of the arc-extinguishing cylinder thereof immersed in oil and released in a tripped/off status.

2. When fault current is detected to pass there-through, the operational apparatus will actuate the movable contact point 40 to detach from the fixed contact point 12 and the insulating oil will immediately fill up the space opened there-between. Meanwhile, the high-pressure fault current will stay between the movable contact point 40 and the fixed contact point 12 in the form of high temperature electrical arc 18 and generate a large amount of vaporized-oil 19 inside the spray-type arc-interrupting chamber 13 disposed at the upper section of the arc-extinguishing cylinder 10 thereof. Due to the difference of pressure, the vaporized-oil 19 will produce an upward momentum to emit upwards there-from so as to quench the electrical arc 18 thereby as shown in FIG. 15.

Figure 16:
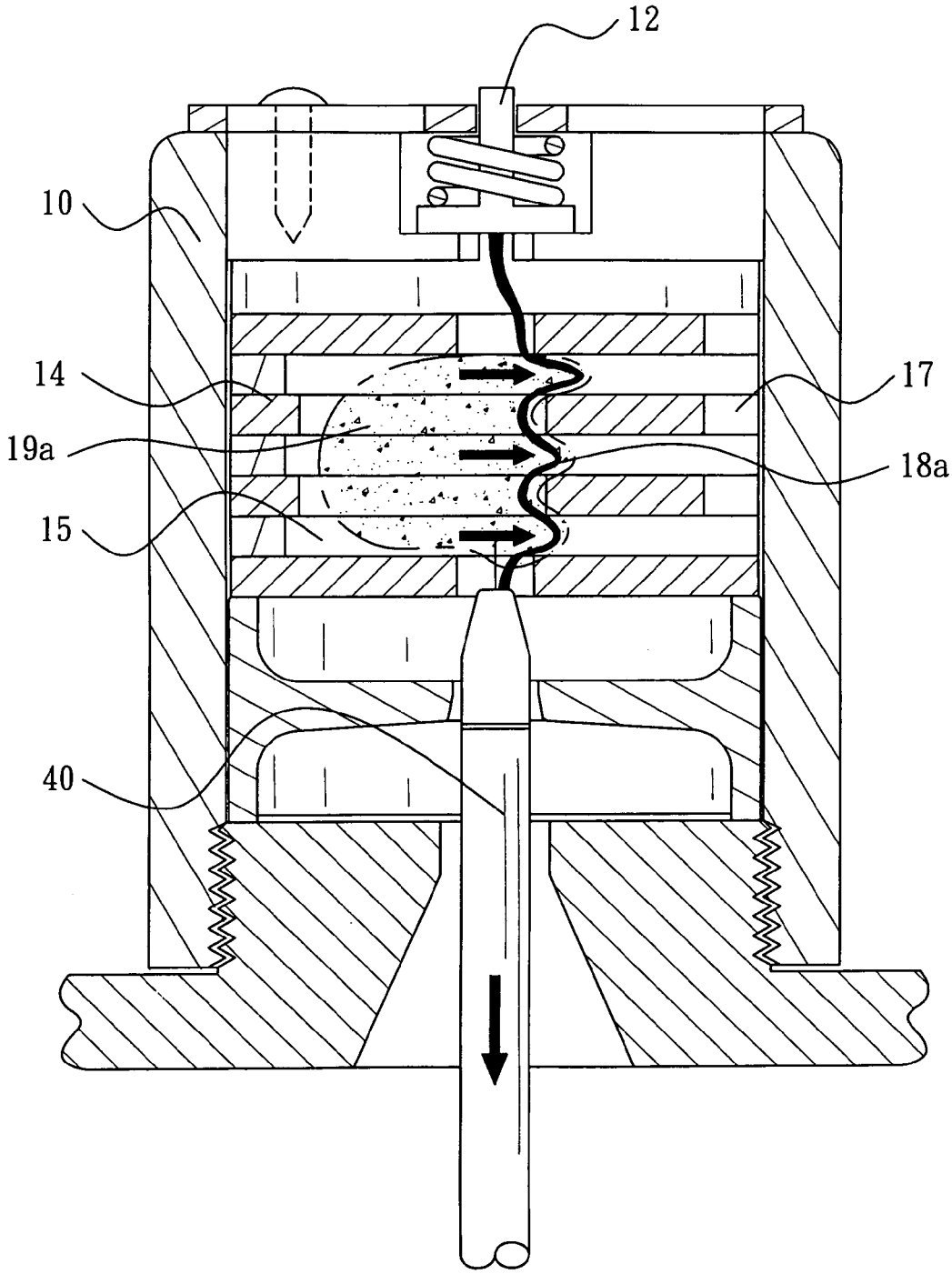
FIG. 16 is another cross sectional view of the arc-extinguishing cylinder thereof immersed in oil and released in a tripped/off status.
Figure 17:
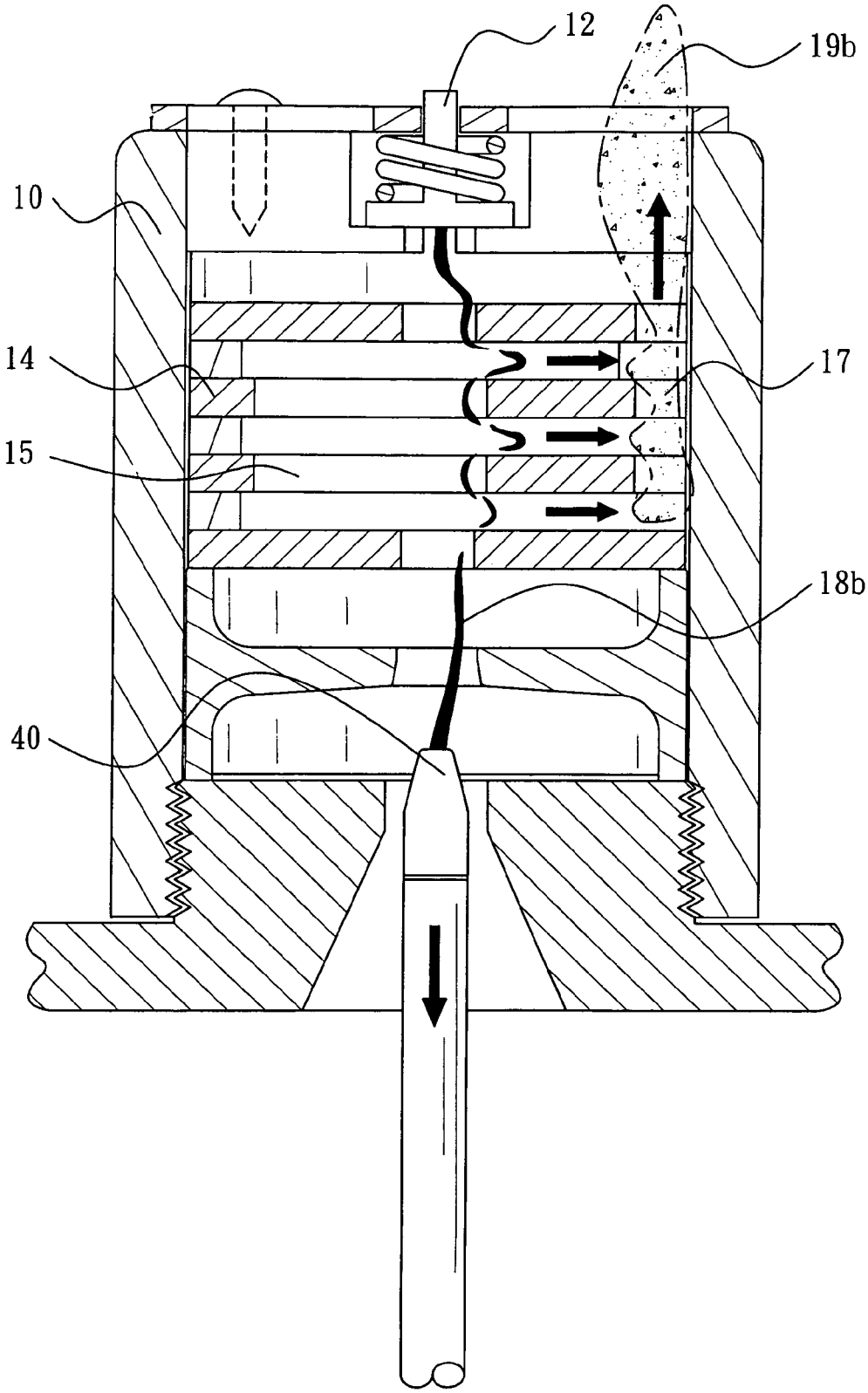
FIG. 17 is a third cross sectional view of the arc-extinguishing cylinder thereof immersed in oil and released in a tripped/off status.

3. When the movable contact point 40 moves through the side-blowing arc-interrupting chamber 15 disposed at the middle section of the arc-extinguishing cylinder 10, if the electrical arc 18 is still unquenched, the expanded vaporized-oil 19*a* will generate a sideway pressure difference in the side-blowing arc interrupting chamber 15 and push the electrical arc 18*a* sideward to the openings of the side-blowing arc-interrupting chamber 15 as shown in FIG. 16 wherein electrical arc 18*b* is cut into a series of disconnected electrical arcs to be interrupted thereby, and vaporized-oil 19*b* is expelled outwards via the gas-emitting channel 17 to complete the trip mechanism of the present invention as shown in FIG. 17.

What is claimed is:

1. An oil-immersed and high-pressure tripping switch structure, comprising an operational apparatus and an arc-extinguishing cylinder wherein the arc-extinguishing cylinder has a fixed contact point fitted at the center of the upper section thereon, and a movable contact point can be guided through the center of the arc-extinguishing cylinder to reciprocally operate with the fixed contact point disposed at the top thereon; the movable contact point is connected to one lateral edge of a movable contact point crank of the operational apparatus having an operation handle attached at one lateral side thereon; the present invention being characterized by that, the rear section of the operational handle thereof is coupled to one end of a linkage rotating rod having the other end thereof connected to a rotary shaft; the rotary shaft has an indented groove disposed thereon to be engaged with one end of a spring rotary arm having one end of a main spring hooked to the middle section thereon; the other end of the spring rotary arm is movably fitted to a main support bracket of the operational apparatus thereof, and a rotatable rebound pivoting-point support is also mounted to the main support bracket thereof; the rebound pivoting-point support has a spring rebound pivoting-point disposed at one lateral edge thereon, to which the movable contact point crank is secured; an actuating trip trigger is connected to one side of the rebound pivoting-point support in a linkage mechanism therewith, and opposite to the trip trigger is disposed an over-current magnetic tripping device and an over-current sensory device that are reciprocally attracted to each other and applied to actuate the trip trigger thereby; the other end of the main spring is attached to the middle section of the movable contact point crank, and the movable contact point is fixed to the other end of the movable contact point crank to cooperatively operate with the arc-extinguishing cylinder thereof; by the displacement of the spring rebound pivoting-point, the contact points thereof can be speedily closed or released, and when the switch is tripped/off, the operational handle will be changed in angle, obviously indicating the interior tripped/off status of the switch thereby;

the arc-extinguishing cylinder has vaporized-oil discharging orifices distributed on four sides at the upper surface thereon, and inside the arc-extinguishing cylinder is sequentially arranged from top to bottom a spray-type arc-interrupting chamber, and a side-blowing arc-quenching mechanism equipped with a gas-emitting channel and a side-blowing arc-interrupting chamber; therefore, when fault current is detected to pass there-through, the operational apparatus will actuate the movable contact point to detach from the fixed contact point and generate an electrical arc thereby; the expanded vaporized-oil is then sent forth upwards via the discharging orifices or/and expelled sideways from the gas-emitting channel so as to quench the electrical arc in a complex arc-interruption mechanism thereof.

2. The oil-immersed and high-pressure tripping switch structure as claimed in claim 1 wherein the switch structure thereof includes an oil-shortage automatic tripping safety device, comprising a buoyant tube with an oil-retaining tank disposed on top thereof and a damping oil cup disposed at the bottom thereof wherein the oil-retaining tank has oil inlets disposed at the top surface thereon, and the damping oil cup is equipped with separation brackets extending thereon; a linkage rod is provided extending from the bottom of the buoyant tube and right through the damping oil cup thereof to connect with one end of an oil-shortage tripping device thereby; therefore, when the oil surface lowers down, the total buoyant force of the buoyant tube will be reduced and a downward pressure be generated to actuate the tripping device and shut down the switch thereof; besides, the damping oil cup and the buoyant tube can also serve an anti-shock property to buffer vibrations, providing a shock-resistant and oil-shortage automatically tripped switch structure thereby.

* * * * *